United States Patent [19]

Davis

[11] 4,078,489

[45] Mar. 14, 1978

[54] SHEET HANDLING APPARATUS

[75] Inventor: William A. Davis, Wickliffe, Ohio

[73] Assignee: Addressograph-Multigraph Corporation, Cleveland, Ohio

[21] Appl. No.: 738,607

[22] Filed: Nov. 3, 1976

Related U.S. Application Data

[62] Division of Ser. No. 590,396, Jun. 25, 1975, abandoned.

[51] Int. Cl.[2] ..... B41F 9/00

[52] U.S. Cl. ..... 101/141; 101/231; 271/184; 271/186

[58] Field of Search ..... 101/232, 229, 230–231, 101/262, 141; 271/185–186, 184, 225; 226/197; 93/62 R

[56] References Cited

U.S. PATENT DOCUMENTS

| | | | |
|---|---|---|---|
| 1,469,168 | 9/1923 | Mets | 271/186 X |
| 3,548,783 | 12/1970 | Knapp | 226/197 |
| 3,954,213 | 5/1976 | Andersen | 226/197 |

*Primary Examiner*—Edgar S. Burr
*Assistant Examiner*—A. Heinz
*Attorney, Agent, or Firm*—Russell L. Root

[57] ABSTRACT

A sheet handling means is provided for use with a duplicating machine. A duplicator is provided having first and second printing couples for printing first on one face of a copy sheet and then on the other and whose paper feed paths are arranged substantially normal to each other. The duplicator also includes special sheet handling means for passing the copy sheet from the first to the second printing couple and also inverting the sheet. The copy sheet is advanced in a first path and direction away from the first printing couple and is advanced in a second path substantially normal to the first path in a second direction towards the second printing couple. The sheet handling means comprises a sheet turn-over device positioned to intersect the copy sheet paths for receiving and progressively inverting the copy sheet as it is advanced in the first path and simultaneously directing the sheet from the first to the second path.

2 Claims, 4 Drawing Figures

SHEET HANDLING APPARATUS

CROSS REFERENCE

This application is a division of copending application Ser. No. 590,396, filed June 25, 1975, now abandoned.

BACKGROUND OF THE INVENTION

In the printing and duplicating field there are various applications where a copy sheet printed on a first surface by a first printing couple is advanced to a second printing couple for printing on the other surface.

While applications such as the foregoing have been normally handled heretofore by arranging the printing couples in straight-line tandem, such tandem arrangements impose certain limitations which restrict the use of the equipment to specific applications. Thus, when the printing couples are arranged in tandem, the overall size of the combined units is extended considerably thereby requiring substantial floor space and precluding the use of such equipment in very small size work areas. Also, when the units are arranged in tandem the machine operator does not have ready access and is not within easy reach of the units and the controls therefor to perform any operations or adjustments that might be required during machine operation.

Furthermore when the printing couples are arranged in tandem, the customary turn-over devices available cause the copy sheets to be turned end-over-end with the result that (1) the master must be placed on the second printing couple in a position reversed with respect to the position of the master on the first printing couple, and (2) the registration of the impressions on the second surfaces of the copy sheets with those on the first surfaces presents a difficult problem in view of the fact that the edge of the sheet used for registration of the impression is the top edge in one case and the bottom edge in the other.

SUMMARY OF THE INVENTION

The invention provides a duplicating machine including a sheet handling means for passing a copy sheet advancing from a first priting couple in a first path and direction to a second path substantially normal to the first path along which the sheet advances in a second direction to a second printing couple. As the sheet is passed from the first to the second path it is also inverted while maintaining the advancement of the sheet in the second path in a condition such that a lead end of the sheet as it moves in the second path is the same end as that which constituted the lead of the sheet as it advanced in the first path.

The sheet handling means comprises a sheet turn-over device of semi-tubular configuration having an axis, and the device is mounted at a position such that the axis intersects the paths with an open face of the semi-tubular device facing the printing couples. The device receives and progressively inverts the sheet as it is advanced in the first path from the first printing couple and simultaneously directs the sheet from the first to the second path for advancement to the second printing couple. Preferably, an air blower device is associated with the sheet turn-over device to prevent smudging of the inked image on a sheet being printed on both sides when the sheet is being inverted and passed from the first to the second path so that the entire organization is especially equipped to successfully handle sheets, having surface conditions such as partially dried ink images, which make necessary minimum rubbing contact during transport.

Because the paths are substantially normal to each other, the printing couples may be arranged in an L-shaped configuration to provide a combined unit substantially more compact than the conventional tandem units. This arrangement also disposes the machine controls and operations to be performed within easy reach of the machine operator such that they are readily accessible to the operator from a common location, thereby reducing the amount of walking normally required by the machine operator when operating conventional tandem equipment.

It is an object of the present invention to provide an improved sheet turn-over device, for use in combination with a duplicating machine having two printing couples, for passing a copy sheet from one printing couple to the other and also inverting the sheet at the same time.

Another object is to provide a semi-tubular sheet turn-over device, having an axis intersecting a first and a second copy sheet path and an open face which faces the printing couples in the two paths for receiving and progressively inverting the sheet advanced in the first path away from the first printing couple and for simultaneously directing the sheet from the first to the second path towards the second printing couple.

Another object is to provide a sheet turn-over device of such character that after turn-over the copy sheet proceeds along its path with the same edge in leading position as occupied the leading position before turn-over.

A feature of the invention is to provide a sheet turn-over device which is simple in construction, inexpensive to produce and reliable in operation.

Other objects, features and advantages of the invention will appear hereinafter as the description proceeds.

IN THE DRAWING

DESCRIPTION OF THE PREFERRED EMBODIMENT

Figure 1:
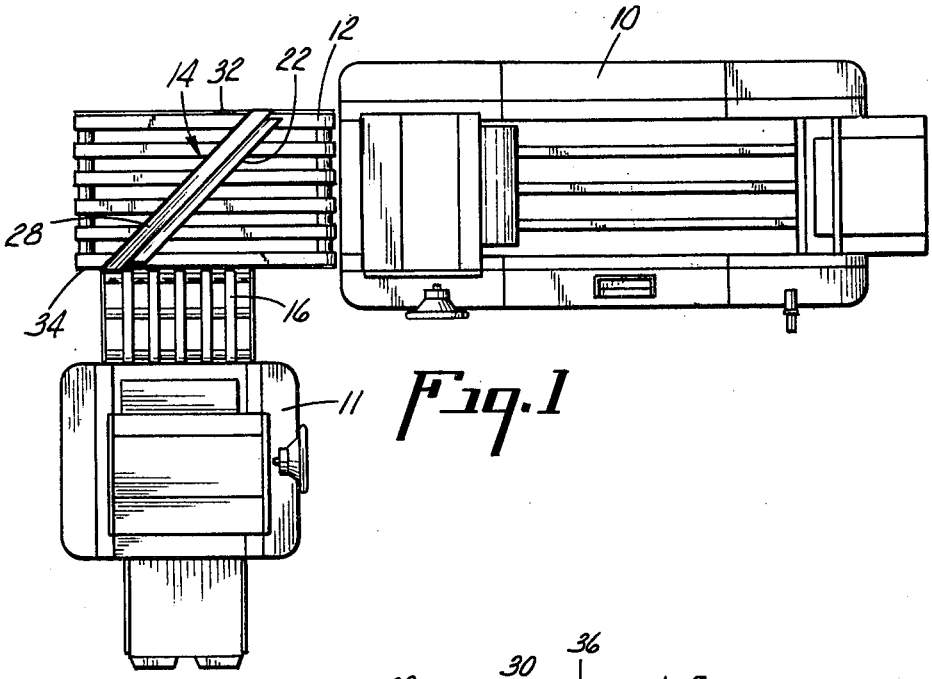
FIG. 1 is a schematic plan view of a duplicator arrangement including two printing couples in association with a sheet turn-over device for passing a copy sheet from the first printing couple to the second in accordance with the present invention.

With reference to FIG. 1 there is shown a duplicating machine ebodying a first printing couple 10, a second printing couple 11,, a first conveyor 12 for advancing a copy sheet from the printing couple 10 to a sheet handling or turn-over device indicated generally by the reference character 14, and a second conveyor 16 normal to the first conveyor 12 for advancing a copy sheet from the turn-over device 14 to the printing couple 11. Although the conveyors 12 and 16 may be of any suitable type, for purposes of this disclosure the conveyors are shown as being endless belt conveyors in which the belts are driven by any suitable power source, not shown in the drawing.

The first and the second conveyors 12 and 16 respectively, define first and second paths respectively. A copy sheet is advanced in a first direction in the first path away from the printing couple 10, is received and progressively inverted by the sheet turn-over device 14, and advanced in a second direction in the second path substantially normal to the first path towards the printing couple 11. The copy sheet is advanced in the first path, inverted and advanced in the second path while maintaining the same edge of the copy sheet in lead position.

Figure 2:
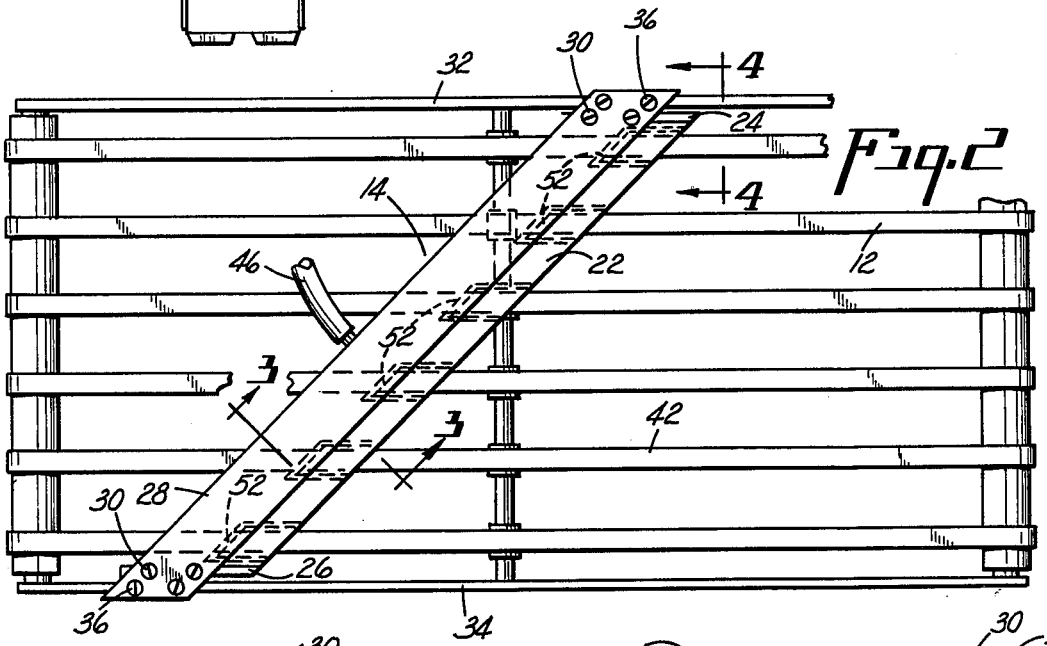
FIG. 2 is a plan view, on an enlarged scale, of a conveyor and the sheet turn-over device of FIG. 1.

The sheet turn-over device 14 comprises a semi-tubular member 22 mounted between a pair of end walls 24 and 26 and secured thereto as by soldering or the like. The end walls 24 and 26 are secured to a mounting bracket 28 with screws 30, and the bracket 28 is secured to conveyor side plates 32 and 34 with screws 36. As shown in FIGS. 1 and 2, the semi-tubular member 22 is mounted on the conveyor 12 such that its axis intersects the first and the second paths and is normal to a bisector of the angle between the paths. The open face of the semi-tubular member 22 faces the printing couples 10 and 11.

In the illustrated embodiment the axis of the semi-tubular member 22 forms an angle of 45° with each of the paths and the copy sheet is passed from the first to the second path at a right angle. However, the conveyors 12 and 16 may be positioned with respect to each other at angles within a range such that the first and the second paths are something other than normal to each other, e.g., from about 60° to about 120°, the only requirement being that the sheet turn-over device is so positioned that the axis of the semi-tubular member 22 is normal to the bisector of the angle between the paths. For the purpose of the present description and claims, this range of angles may be considered substantially normal, and is so referred to hereinafter.

Figure 3:
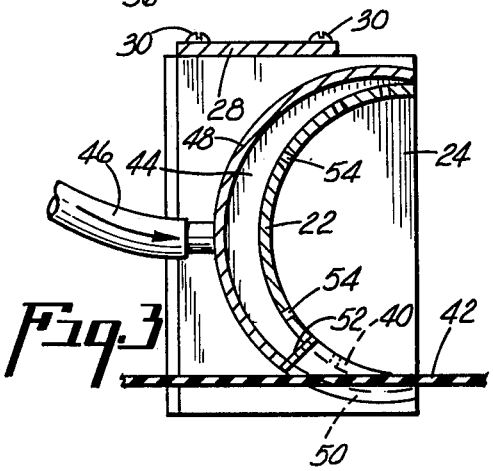
FIG. 3 is an enlarged section taken substantially on the line 3—3 of FIG. 2.

In order for the conveyor 12 to advance the copy sheet up and into the sheet turn-over device 14, and to continue to advance the sheet as it is being inverted by the semi-tubular member 22, the lower edge of the member 22 is provided with a series of clearance openings 40 for the passage therethrough of endless belts such as the belt 42 shown in FIG. 3. In this way the lower or lead edge of the semi-tubular member 22 is positioned below the plane of the belts so that the sheet is unobstructed in its advancement into and around the inside curved surface of the semi-tubular member 22 for inverting the sheet and directing it to the conveyor 16. As the sheet is being advanced by the conveyor belts 42 and inverted by the turn-over device 14, the sheet exits at the upper edge of the semi-tubular member 22 and falls by gravity onto the conveyor 16 for transport to the sheet distributor 18.

The present invention also provides an air blower means to prevent undue frictional contact of the sheet against the sheet turn-over device. As shown in FIG. 3 there is provided a plenum 44, associated with the sheet turn-over device 14, for receiving a supply of compressed air. The air is supplied to the plenum 44 by an inlet conduit 46 connected to a suitable source of compressed air not shown in the drawing. The plenum 44 comprises a curved wall 48 positioned behind and spaced from the semi-tubular member 22. The curved wall 48 positioned behind and spaced from the semi-tubular member 22. The curved wall 48 is also mounted between the end walls 24 and 26 and is secured thereto as by soldering or the like to provide a closed chamber.

The lower edge of the curved wall 48 is also provided with clearance openings 50 for the passage of the endless belts therethrough, as shown in FIG. 3, and the lower edge is also positioned below the plane of the belts in the same way as the lower edge of the semi-tubular member 22. To prevent leakage of compressed air from the plenum in the areas of the clearance openings 40 and 50, there is provided at each of the clearance openings a U-shaped member 52 which encloses the sides of the openings and extends between the semi-tubular member 22 and the curved wall 48. These U-shaped members 52 may also be secured in place as by soldering or the like.

Figure 4:
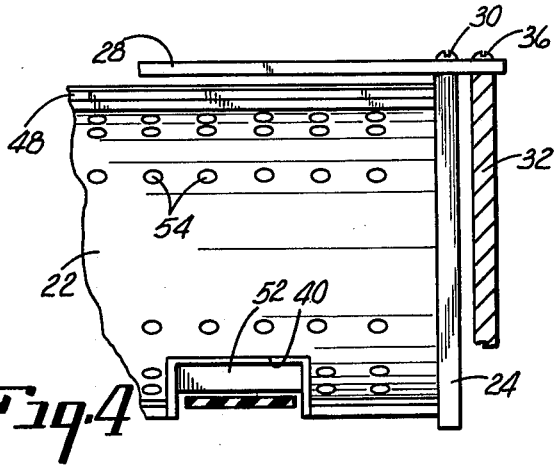
FIG. 4 is an enlarged section taken substantially on line 4—4 of FIG. 2.

As shown in FIGS. 3 and 4, the semi-tubular member 22 is provided with a plurality of holes 54 communicating with the plenum 44. Thus, as the copy sheet enters the semi-tubular member 22, the holes 54 direct controlled jets of air against the sheet to thereby prevent the sheet from rubbing or dragging against the semi-tubular member as it passes around the inner surface of the member 22.

The sheet turn-over device of the present invention provides for passing copy sheets from a first path to a second path substantially normal to the first path and also inverting the copy sheets. Even though the copy sheets travel at high speed and in closely spaced relation, the device handles the copy sheets in a manner which is extremely simple mechanically, is without danger of interference between adjacent sheets which might result in jamming, and which also satisfies the important and practical economic and space requirement restrictions.

Further, because the printing couple and the collator may be arranged in an L-configuration, the equipment is more compact than conventional tandem arrangements and provides the machine operator greater accessibility to various controls and operations to be performed during machine operations.

When the sheet turn-over device of the present invention is employed between two printing couples as hereinabove described, to effect printing on both sides of a copy sheet, it provides the advantage of maintaining the same edge of the copy sheet in lead position after the sheet has been inverted. This permits installing both masters with the same orientation, and still printing both sides of the sheet in a head-to-head relation, and also allows the printed images on both sides of the sheet to be registered from the same edge of the sheet, normally the edge which will form the top of the sheet.

What is claimed is:

1. A sheet handling device for moving a flexible cut sheet along a first path, inverting the sheet and then moving it along a second path substantially normal to the first path, comprising:

a belt conveyor for moving the sheet along the first path;

a sheet turnover device comprising a semi-tubular member having an axis intersecting the first and the second paths and normal to a bisector of the angle between the paths, said semi-tubular member including a concave sheet guide surface facing the paths and free of any mating guide surfaces;

a lower entrance edge of the semi-tubular member positioned at a level below the first path for receiving the sheet and directing it upwardly towards an upper exit edge of the semi-tubular member to progressively invert the sheet as it is advanced in the first path and simultaneously direct the sheet from the first to the second path, the sheet being transported by gravity from the upper exit edge of the semi-tubular member to the second path;

wall means positioned behind the sheet guide surface of the semi-tubular member and spaced therefrom for providing a plenum for receiving a supply of compressed air, said wall means having a bottom edge adjacent the lower entrance edge of the semi-tubular member;

means for supplying the plenum with compressed air;

a plurality of perforations in the semi-tubular member in communication with the plenum for directing controlled amounts of compressed air against the sheet as it traverses the sheet guide surface of the semi-tubular member;

clearance opening means provided in the bottom and the lower entrance edges for receiving the belt conveyor to permit unobstructed advancement of the sheet into and around the inside of the sheet guide surface of the semi-tubular member; and conveyor means for receiving the sheet as it leaves the upper exit edge of the sheet guide surface of the semi-tubular member and transporting it along said second path;

whereby sheets having surface conditions such as partially dried ink images, which make necessary minimum rubbing contact during transport, can be successfully handled.

2. A duplicating machine including a first printing couple for applying a lithographic ink image to one face of a flexible cut sheet and having a first sheet path in a predetermined direction, and a second printing couple for printing on the other face of the sheet after it issues from the first printing couple and having a second path substantially normal to the first path, a sheet handling device for moving the sheet along the first path, inverting the sheet and then moving it along the second path, comprising:

a belt conveyor for moving the sheet along the first path;

a sheet turnover device comprising a semi-tubular member having an axis intersecting the first and the second paths and normal to a bisector of the angle between the paths, and semi-tubular member includng a concave sheet guide surface facing the paths and free of any mating guide surfaces;

a lower entrance edge on the semi-tubular member positioned at a level below the first path for receiving the sheet and directing it upwardly towards an upper exit edge of the semi-tubular member to progressively invert the sheet as it is advanced in the first path and simultaneously direct the sheet from the first to the second path, the sheet being transported by gravity from the upper exit edge of the semi-tubular member to the second path;

wall means positioned behind the sheet guide surface of the semi-tubular member and spaced therefrom for providing a plenum for receiving a supply of compressed air, said wall means having a bottom edge adjacent the lower entrance edge of the semi-tubular member;

means for supplying the plenum with compressed air;

a plurality of perforations in the semi-tubular member in communication with the plenum for directing controlled amounts of compressed air against the sheet as it traverses the sheet guide surface of the semi-tubular member;

clearance opening means provided in the bottom and the lower entrance edges for receiving the belt conveyor to permit unobstructed advancement of the sheet into and around the inside of the sheet guide surface of the semi-tubular member; and conveyor means for receiving the sheet as it leaves the upper exit edge of the sheet guide surface of the semi-tubular member and transporting it along said second path;

whereby sheets having surface conditions such as partially dried ink images as a result of a lithographic image applied thereto by the first printing couple, which make necessary minimum rubbing contact during transport, can be successfully handled.

* * * * *